United States Patent [19]

Partington

[11] 4,337,811

[45] Jul. 6, 1982

[54] ROTARY PLANER

[76] Inventor: Everett J. Partington, 620 S. Elizabeth, Oconomowoc, Wis. 53066

[21] Appl. No.: 277,172

[22] Filed: Jun. 25, 1981

Related U.S. Application Data

[63] Continuation-in-part of Ser. No. 5,556, Jan. 22, 1979, abandoned.

[51] Int. Cl.[3] ..... B27C 1/10

[52] U.S. Cl. ..... 145/4.2

[58] Field of Search ..... 145/4.2

[56] References Cited

U.S. PATENT DOCUMENTS

| | | | |
|---|---|---|---|
| 1,329,383 | 2/1920 | Eaton | 145/4.2 |
| 1,564,349 | 12/1925 | Hires | 145/4.2 |
| 1,812,755 | 6/1931 | Quinsler | 145/4.2 |
| 2,015,220 | 9/1935 | Harkin | 145/4.2 |
| 2,030,520 | 2/1936 | Heimsath | 145/4.2 |
| 2,395,158 | 2/1946 | Yandell | 145/4.2 |
| 2,497,941 | 2/1950 | Hobson | 145/4.2 |
| 2,746,499 | 5/1956 | Greeley | 145/4.2 |
| 3,731,338 | 5/1973 | Walsh et al. | 145/4.2 |
| 4,069,568 | 1/1978 | Sakamoto et al. | 145/4.2 |

*Primary Examiner*—James G. Smith
*Assistant Examiner*—J. T. Zatarga
*Attorney, Agent, or Firm*—Andrus, Sceales, Starke & Sawall

[57] ABSTRACT

A rotary planer for use in planing wood or removing paint or other finishes. The planer includes a body or casing having an outer surface adapted to ride on the work surface, and a pair of rotating cutters are journalled within openings in the outer surface and are connected by a drive mechanism to an input drive shaft that is adapted to be connected to a conventional power hand drill. Through operation of the drill, the cutters rotate in opposite directions, and the periphery of each cutter is formed with a series of punched-out teeth which engage the work surface. The trailing edge of the outer surface of the body is provided with a discharge recess and the wood chips are discharged through the recess. An adjustable guide plate is mounted on the body and serves to adjust the depth of cut of the rotary cutters.

7 Claims, 4 Drawing Figures

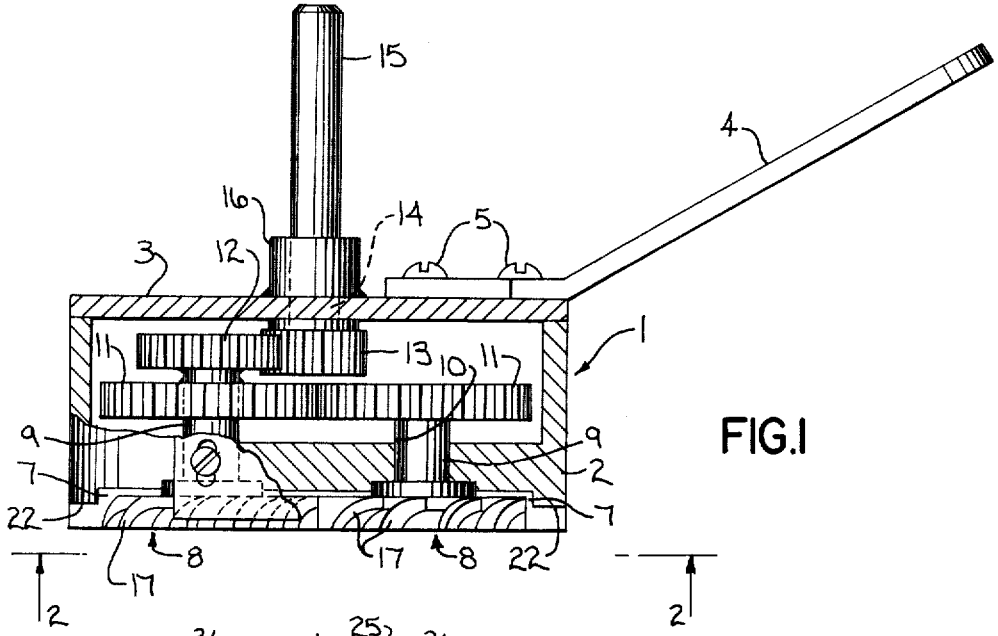
FIG.1
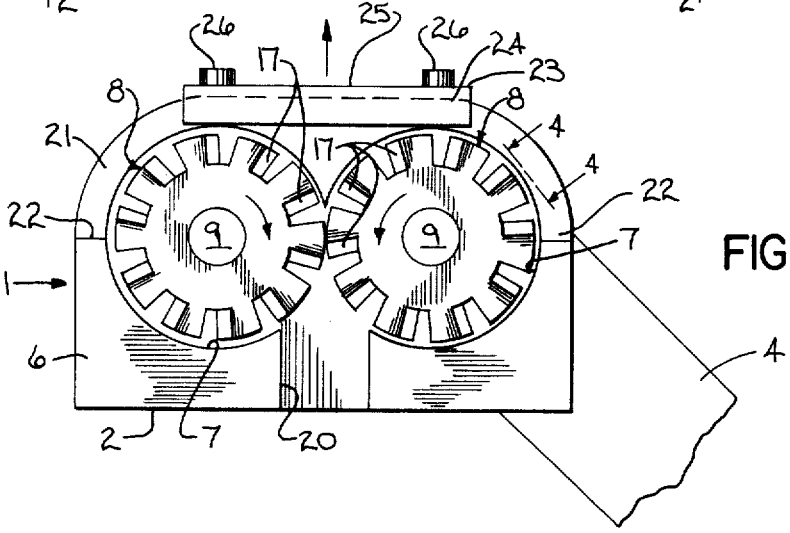
FIG.2
FIG.3
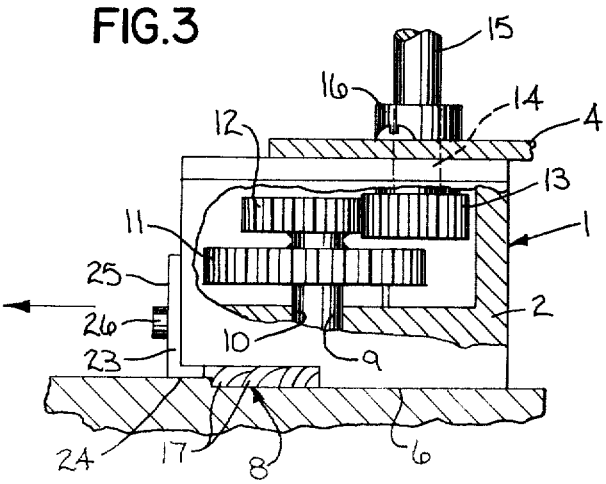
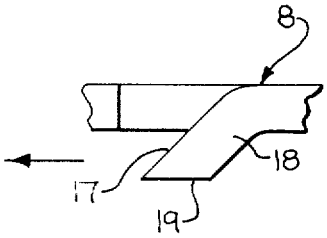
FIG.4

ROTARY PLANER

This application is a continuation-in-part of application Ser. No. 06/005,556, filed Jan. 22, 1979, and now abandoned.

BACKGROUND OF THE INVENTION

Planing of wood surfaces is generally accomplished by means of a hand plane. Planes, as used by carpenters, are relatively large and heavy and are difficult to maneuver in certain positions. In addition, care has to be taken to insure that the blade projects equally from the slot in the base of the plane in order to obtain a uniform depth of cut and prevent gouging of the working surface. Care must also be taken when planing an edge of the workpiece. The stroke must be toward the workpiece, for a stroke away from the workpiece may tend to splinter the edge.

A power hand drill is a popular tool for the home owner, and in the past there have been a variety of attachments for a power drill, such as buffers, paint strippers, polishers, and the like, to take advantage of the rotary drive of the drill.

SUMMARY OF THE INVENTION

The invention is directed to a rotary planer to be attached to a conventional hand power drill. The planer includes a body or casing having a generally flat outer surface which is adapted to ride on the workpiece, and a pair of rotating cutters are journalled adjacent each other within openings in the outer surface of the body. The cutters are connected through a drive mechanism to an input drive shaft that is adapted to be connected to a conventional hand drill. Through operation of the drill, the cutters rotate in opposite directions, and the periphery of each cutter is formed with a series of punched-out teeth which engage the work surface as the planer is moved across the surface.

To discharge the wood chips and other cut particles, the trailing edge of the outer surface of the casing is formed with a discharge recess or slot that communicates with the opening that house the cutters. The cutters rotate in a direction such that the cut particles are discharged through the recess to the exterior.

In order to adjust the depth of cut, an adjusting plate is mounted on the outer surface of the body, and by adjustment of the plate, the depth of the cut can be varied.

The rotary planer of the invention can be readily attached to a conventional hand drill and provides a smooth planing cut.

As the rotary cutters are mounted in the openings in the flat outer surface of the body and the teeth project a uniform distance beyond the surface, the cutters will not gouge the workpiece even if the planer is tilted during operation. As the cutters rotate inwardly, toward the center of the planer, they will not break away or splinter the edge of the workpiece, as the planer moves across the edge.

The depth of the cut can be readily varied through adjustment of the adjusting plate to thereby enable the rotary planer to make thin or heavy cuts depending on the particular operation.

The rotary planer of the invention also has the advantage that it can be used in locations where the use of a hand plane is inaccessible.

The rotary planer cannot only be used to plane wood surfaces, but can also be used to remove paint and other finishes from surfaces.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of the rotary planer;

FIG. 2 is a bottom view of the planer;

FIG. 3 is an end view with parts broken away in section; and

FIG. 4 is a section taken along line 4—4 of FIG. 2 and showing the planer engaging a surface to be cut.

DESCRIPTION OF THE PREFERRED EMBODIMENT

The drawings illustrate a rotary planer to be attached to a conventional power drill. The planer includes a casing or body 1 having a base section 2 and a cover 3 which is attached to the base by suitable screws.

A handle 4 is mounted on the outer surface of the cover 3, and the outer end of the handle is adapted to be gripped by the operator to prevent the casing from rotating with the operation of the drill. Handle 4 is secured to the cover by means of screws 5.

The base section 2 of the casing 1 is provided with a generally flat outer surface 6 which is adapted to ride against the work surface as the cut is made. The outer surface 6 as best illustrated in FIG. 2, is provided with a pair of generally circular openings 7 which communicate with each other and rotary cutters 8 are mounted within one of the openings 7.

As shown in FIG. 2, the cutters 8 are rotated in opposite directions by a conventional gear drive. As illustrated each rotary cutter 8 is mounted on the outer end of shaft 9 which is journalled within a passage 10 in the base section 2. The inner end of each shaft 9 carries a gear 11 and one of the shafts 9 also carries a second gear 12 that is driven by a pinion 13 mounted on the inner end 14 of drive shaft 15 which is journalled within the hub portion 16 of the cover 3. The outer projecting end of shaft 15 is adapted to be connected to the power operated hand drill.

With this construction, rotation of the drive shaft 15 and pinion 13 will drive the rotary cutters in opposite directions, as shown in FIG. 2. The planer is adapted to be moved across the work surface in the direction of the arrow, as shown in FIG. 2 and the cutters rotate inwardly and rearwardly, as shown by the arrows, with respect to the direction of travel of the planer.

Each of the rotary cutters 8 is provided with a plurality of peripheral teeth 17. The teeth 17 are formed by punching out notches or tabs in the periphery of each rotary cutter, and each tooth includes a diagonal, downwardly bent portion 18 and an outer edge or face 19. The faces 19 are ground so that they lie in a common plane which is normally to the base of the respective cutter and parallel to the plane of the outer surface 6.

As the planer is moved across the work surface, the rotating teeth 17 engage the work surface and cut the same. To provide a controlled discharge of the splinters or particles, the trailing end of the outer surface 6 is provided with a discharge recess 20 which communicates with the openings 7. The cut particles are directed through the discharge recess 20 to the exterior.

The rotary planer also includes a provision for adjusting the depth of cut. As shown in FIGS. 2 and 3, the forward portion of the outer surface 6 is offset inwardly, with the offset portion 21 being defined by a pair of shoulders 22. A generally L-shaped adjusting plate 23 is mounted along the forward end of the body, and includes a surface 24 which is located generally parallel to the surface 6, and a surface 25 that is normal to the surface 6. The adjusting plate 23 is mounted to the base section 2 of the casing by a pair of set screws 26 which are disposed within slots 27 in the surface 25 and engaged with openings in the base section. By loosening the set screws 26 and adjusting the plate 23, the guide surface 24 can be adjusted relative to the faces 19 of the cutting teeth 17 to thereby provide a convenient method of adjusting the depth of the cut, up to 1/32 inch.

In operation, the planer is positioned to engage the end of a board or workpiece 28, and as the planer is moved across the board, as shown in FIG. 3, the plate 23 rides on the uncut portion of the board 28, while the base 6 rides on the portion of the board that has been cut by the blades 8.

The use of a pair of rotary cutters 8 balances the torque and enables the planer to be moved in a relatively straight path of movement along the work surface. If a single cutter was utilized, the planer would tend to walk or shift due to the torque of the single cutter.

The rotary planer can be readily attached to any conventional power operated drill and provides a smooth cut which can be made faster than can be made with the normal hand plane. As the rotary cutters 8 are relatively small in diameter, the rotary planer can be used in locations where hand planes are inaccessible.

As the cutters, as shown in FIG. 2, rotate toward the center of the planer and rearwardly, with respect to the direction of travel, there is no tendency to break away the edges of the workpiece, as the planer passes over the edge.

As the rotary cutters are fixed in position relative to the outer surface 6, the cutters cannot tilt with respect to the surface so there is no possibility of gouging the work surface.

The depth of cut can be readily adjusted by the operator by merely adjusting the position of the guide plate 23.

Various modes of carrying out the invention are contemplated as being within the scope of the following claims particularly pointingout and distinctly claiming the subject matter which is regarded as the invention.

I claim:

1. A rotary planer to be moved across a work surface to plane the surface, comprising a body having a generally flat outer face and having a pair of communicating openings in said face, the forward portion of said face, with respect to the direction of travel of said planer, being offset inwardly from the plane of said face to provide an inwardly offset forward portion, a rotary cutter journalled within each of said openings, and a drive mechanism interconnecting the cutters with a rotating power source, said drive mechanism including means for rotating the cutters in opposite directions, each rotary cutter including a plurality of teeth disposed circumferentially of the respective cutter, the outer extremities of said teeth being substantially flush with said face and the outer extremities of said teeth projecting outwardly beyond said offset forward portion, movement of said planer in said direction of travel effecting engagement of the projecting teeth with the work surface to plane said surface, said face riding on the planed surface as said planer moves in said direction of travel.

2. The rotary planer of claim 1, and including an adjustable guide member, and means for mounting the guide member for linear movement on the forward end of said body in a direction parallel to the axes of said cutters, said guide member having a guide surface projecting beyond said offset forward portion toward the plane of said face, adjustment of the position of said guide member serving to vary the depth of the cut of said cutters.

3. The planer of claim 2, wherein said guide surface is elongated and is generally parallel to said face, said guide surface having a length greater than the distance between the axes of said cutters.

4. The rotary planer of claim 1, wherein said teeth comprise outwardly bent tabs, each tooth having a diagonal portion extending diagonally of said face and terminating in a cutting edge disposed substantially flush with said face.

5. The rotary planer of claim 1, wherein the rear portion of the outer face of the body, with respect to said direction of travel of said planer, has a recess communicating with said openings, said recess providing a controlled discharge of the particles cut by said cutters.

6. The rotary planer of claim 1, and including a handle extending outwardly from said body and adapted to be grasped by the operator.

7. The rotary planer of claim 1, wherein said drive mechanism includes a gear train disposed to operate the cutters in opposite directions, said cutters rotating inwardly of the body with respect to the direction of movement of said body across said work surface.

* * * * *